US007568860B2

(12) United States Patent
Chiaves

(10) Patent No.: US 7,568,860 B2
(45) Date of Patent: Aug. 4, 2009

(54) SYSTEM FOR ARTICULABLY BEARING A PREFABRICATED STRUCTURAL MEMBER ON A FOUNDATION

(76) Inventor: Carlo Chiaves, Corso Govone 10, Torino (IT) I-10129

( * ) Notice: Subject to any disclaimer, the term of this patent is extended or adjusted under 35 U.S.C. 154(b) by 532 days.

(21) Appl. No.: 10/885,467

(22) Filed: Jul. 7, 2004

(65) Prior Publication Data

US 2005/0034394 A1 Feb. 17, 2005

(30) Foreign Application Priority Data

Jul. 8, 2003 (IT) ..... TO2003A0519

(51) Int. Cl.
*F02D 29/00* (2006.01)

(52) U.S. Cl. ..... 405/134; 405/126

(58) Field of Classification Search ..... 52/88, 52/89, 86, 690, 223.3, 169.1, 292, 169.6; 405/134, 124, 125, 126, 150.1, 151, 152, 405/153, 132, 155

See application file for complete search history.

(56) References Cited

U.S. PATENT DOCUMENTS 886,666 A * 5/1908 Thomas ..... 52/89
1,997,236 A * 4/1935 Schroeder, Jr. ..... 405/125
4,015,383 A * 4/1977 Crowley ..... 52/223.3
4,290,246 A * 9/1981 Hilsey ..... 52/169.1
4,693,634 A * 9/1987 Chiaves ..... 405/126
4,693,635 A * 9/1987 Matiere ..... 405/132
4,983,070 A * 1/1991 Hwang ..... 405/124
4,987,707 A * 1/1991 Kiselev et al. ..... 52/88
5,092,710 A * 3/1992 Matiere ..... 405/149
5,180,254 A * 1/1993 Matiere ..... 405/155
5,281,053 A * 1/1994 Matiere ..... 405/149
5,950,392 A * 9/1999 Short et al. ..... 52/690
6,129,484 A * 10/2000 Chiaves ..... 405/134
6,205,717 B1 * 3/2001 Shall et al. ..... 52/89
6,205,725 B1 * 3/2001 Butler ..... 52/292
6,393,776 B1 * 5/2002 Waller et al. ..... 52/169.6
6,938,382 B2 * 9/2005 Schmitz ..... 52/89
7,207,616 B2 * 4/2007 Sturt ..... 296/26.1

* cited by examiner

*Primary Examiner*—Richard E Chilcot, Jr.
*Assistant Examiner*—Chi Q Nguyen
(74) *Attorney, Agent, or Firm*—Sughrue Mion, PLLC

(57) ABSTRACT

A system for articulably bearing a prefabricated structural member on a foundation includes a first static hinge interposed between the base of the upright of the structural prefabricated member and the foundation, and an additional static hinge which is also arranged between the base of the upright and the foundation and has a rotation axis parallel and separated from that of the first static hinge.

11 Claims, 2 Drawing Sheets

SYSTEM FOR ARTICULABLY BEARING A PREFABRICATED STRUCTURAL MEMBER ON A FOUNDATION

BACKGROUND OF THE INVENTION

The present invention refers to reinforced concrete prefabricated structures. These structures, in particular, are used for manufacturing works, such as road overpasses, underpasses, bridges, artificial tunnels, garages, underground parkings or similar, by means of a series of arched or portal-shaped segments, which are installed in succession along an axis of the work until the desired dimension of the work is reached. In the case of the most common structures of this type, each segment of the work consists of one or more prefabricated structural members defining one or more uprights bearing on respective foundation elements.

Usually, each prefabricated member may have reinforcing rods which protrude below from the upright or the uprights thereof, and are intended to be incorporated in a concrete casting executed during the work, which constitutes the base or foundation structure for the uprights. In this manner, a fully rigid fixed joint is made between the structural member and the base structure. However, this kind of rigid connection may reveal to be inadequate to satisfy some desired requirement. For example, it does not allow the constructive work structure to support without possible damages yieldings of the foundation plinths. Moreover, the reinforcing rods which protrude from the uprights make the structural members bulky and therefore affect negatively their capacity to be transported.

It would be instead preferable to use systems for bearing the uprights of the structural members which have no protruding reinforcing rod and which are able to allow at least a small ability of articulation of the structural members. A bearing system of this kind consists of a so-called "static hinge" interposed between the base of each upright and the respective base structure.

SUMMARY OF THE INVENTION

Such a system is known from EP-A-219 501 and EP-A-861 358, both in the name of the same Applicant. These documents refer to open-air works formed by a series of arched or portal-shaped segments manufactured by means of prefabricated structural members which have one static hinge at the base of each upright for bearing on a foundation structure, such as a concrete bed or a continuous foundation plinth. These prefabricated structural members are preferably of the so-called articulated type, that is manufactured by a series of reinforced concrete bodies connected to each other by common reinforcing rods protruding between the reinforced concrete bodies, and are intended to be folded during the installation of the various members, so as to allow each member to assume an overturned L configuration after they have been installed, starting from their flat configuration for transportation. In the case of the prefabricated members having five bodies separated by four articulations, each prefabricated member comprises a pair of uprights at whose base a respective static hinge is formed. In the case of the prefabricated members having three bodies separated by two articulations, each segment of the structure consists of at least two of such structural members, a single static hinge being formed at the base of the upright of each member, while the opposite end of each structural member is intended to be borne, usually in an articulated manner, to another similar and symmetrical structural member or to a generally rectilinear prefabricated member interposed in a central position between two structural members arranged symmetrically.

However, in this known bearing system, the bending moment at the static hinges at the base of each segment is nullified, and therefore a considerable increase of the bending stresses takes place in other portions of the structure. Often it is necessary to oversize the various structural members in order to oppose such bending stresses, which consequently causes an increase of the transport and manufacturing costs.

In order to overcome the drawbacks of the known bearing systems, the subject of the invention is a system for articulably bearing a prefabricated structural member on a foundation, having the features set forth in annexed claim 1.

By virtue of these features, the system of the invention, which comprises two static hinges spaced to each other at the zone of the base of each upright of the prefabricated member which bears on the foundation, allows the rotation of each structural member to take place about the center of one or the other base static hinge, depending on the kind of movement the respective structural member is subject to. In such a manner, in the condition under load, one or the other static hinge is used depending on the tendency of the upright base to rotate in one direction or the other. This solution with a double base static hinge allows to achieve the remarkable practical advantage that the bearing system for the upright of each structural member acts like a fixed joint when the straight line of action of the resultant of the forces acting on the structural member intersects the space of distance between centers of the two base static hinges, while, when the straight line of action of the resultant goes beyond the axis of one of the two static hinges, the bearing system acts like a bearing articulated with respect to that hinge, so that a small rotation of the structural member is accomplished until the overall structure reaches a new balanced configuration in which the straight line of action of the resultant of the stresses pass through the axis of that static hinge.

This bearing system with a double base static hinge is therefore able to support a bending moment of a maximum predetermined amount, which is equal to the product of the distance between centers of the two base static hinges and the stress applied perpendicularly, but no higher bending moment because, beyond this threshold, the behaviour of an articulated bearing is accomplished, in which the bending moment is zero. This behaviour turns out to be favourable in many applications in the field of constructions, both with respect to a usual completely fixed joint or with respect to a simple hinge.

In fact, in the case of a fixed joint connection, the section of the fixed joint tends to be very stressed since the bending moment and the shearing stress usually have high values, which therefore requires this section to be oversized in order to safely support the maximum stresses it can be subject to.

Also in the case of an articulated connection, which is typical of the single hinge, the bending stresses are high in other portions of the structure, owing to the fact that the bending moment at the hinge is zero, so that the structural members have to be oversized.

The connection with a double base static hinge, which is the subject of the invention, allows to apply a bending moment with a preset arm, equal to the distance between centers of the two base hinges, which turn out to be fully adequate for dimensioning the structural member in the zone of the upright and allows therefore to take advantage of the bending strenght of the section of this zone in an optimal manner, without any risk to exceed the value for which it has been calculated. This optimal exploitation of the strenght allows, in the most of the cases, to reduce the dimensioning of the portions of the work, which consequently causes a reduction of its overall costs.

Moreover, the double base static hinge has the advantage that the zone of the prefabricated member interposed between the axes of the two static hinges tends in any case to move away from the zone of the foundation on which the member bears, for any direction of the rotation of the upright, so that an interference of this zone with the adjacent portion of foundation never takes place. By virtue of this fact, support and adjusting members may be arranged at this zone to be used during the assembly of the prefabricated member, which can be left in place with no influence on operation of the two base static hinges.

In the prefabricated members of the prior art, which have a single base static hinge, special measures have instead to be taken in order to avoid any interference between the portions, following to a rotation. For example, it is necessary to prepare in advance hollows or spaces between the portions intended to perform relative movements, in which material adapted to contract as a result of the application of a compression are inserted, such as polystyrene sheets, or the end of the prefabricated member must be tapered in order to avoid an interference with the base structure may take place, which could oppose its rotation.

Further characteristics and advantages of the invention will turn out to be more clear from reading the following detailed description, which has been provided as a non-limitative example and has been made with reference to the appended figures, in which:

DETAILED DESCRIPTION OF THE INVENTION

With reference to the figures, an arched or portal-shaped segment of an open-air work is generally indicated 10. The work is erected on a level area, possibly obtained as a result of the execution of a digging, by means of the installation of a succession of segments 10 along an axis of the work, until the design dimensions are reached.

Figure 1:
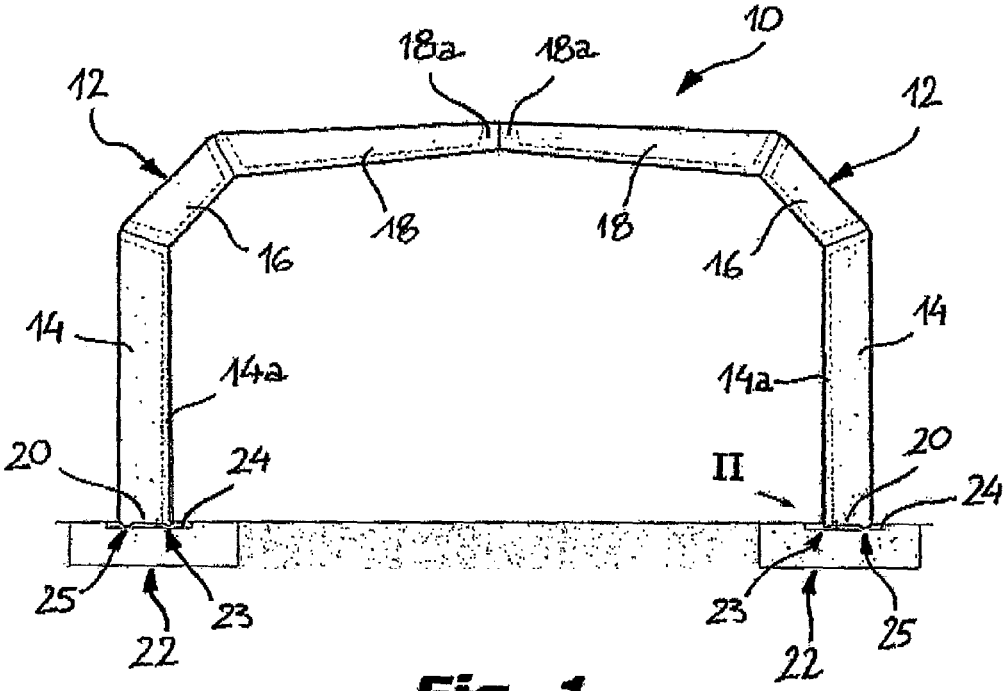
FIG. 1 is a schematic front elevational view of a segment of an open-air work, comprising a pair of prefabricated structural members placed side by side and bearing on respective foundation structures.

In spite of the fact that the segment 10 of FIG. 1 has a structure closed both above and sideways and comprises a pair of uprights resting on a foundation, also a work, possibly not of the open-air type, and also made by a succession of open segments or single members each of which is provided with a single upright, which define a structure open sideways and/or above, falls within the scope of the invention.

In the case of segments provided with a pair of uprights and forming a closed structure, if each of them is made by a single structural member, this member itself will be provided with a pair of uprights and will have a general overturned U-shaped structure in the installed condition. If each segment of the work is instead made by means of two or more structural members, the uprights of the work will be constituted by a portion of the two prefabricated structural members which are arranged sideways with respect to each segment, and will have a general overturned L-shaped structure in the installed condition, between such two members being possibly interposed a third prefabricated member arranged in a central position.

The segment 10 of FIG. 1 is preferably constituted by two prefabricated structural members 12 of the so-called articulated type, generally known per se and described in EP-A-219 501 and EP-A-861 358, which are arranged so as to face each other in a symmetrical position with respect to the axis of the work, according to a substantial overturned L configuration. In short, each prefabricated member 12 comprises three bodies of reinforced concrete connected by reinforcing rods extending at the zones interposed between pairs of adjacent bodies, which act as articulation zones, in such manner that each member 12 takes on the aforesaid L configuration as a result of the bending of the reinforcing rods at these zones during the installation of the members 12. The bodies of each member 12 consist of a first rectilinear body 14 acting as an upright and having a panel portion 14*a* on the side facing the axis of the work, an intermediate rectilinear body 16 constituting a bevel of the L and another rectilinear bracket body 18 having a cantilever end 18*a*. The ends 18*a* of the two members 12 can be substantially fixed to each other or connected by means of an articulation (which cannot be seen in FIG. 1) which constitutes a central hinge of each segment 10.

Each upright 14 has a base portion 20 intended to rest on a respective foundation structure 22, such as a concrete bed or a continuous kerb of foundation, having an upwardly open channel-shaped bearing seat 24 in order to be able to receive the base portions 20 of the members 12.

A pair of convex appendages 26, 28 separated to each other extend from each base portion 20, each of which constitutes a half-portion of a respective static hinge 23 and 25, as it will be more clear in the following.

Preferably, the convex appendages 26, 28 are defined by respective cylindrical surfaces fast to the upright 14, which extend from the upright 14 and are separated by a rectilinear portion 30, both the axes of the cylindrical surfaces being parallel to the general axis of the work.

Temporary support means 35 are arranged at the rectilinear portion 30 and, conveniently, in an intermediate position between the two static hinges 23 and 25, for supporting the upright 14. The support means 35 are adapted to hold the base portion 20 raised with respect to the bottom of the bearing seat 24, when the upright 14 is placed on the foundation 22 during the assembly. The support means 35 have preferably an adjustable extension, so that the distance between the base 20 of each upright 14 and the support seat 24 can be adjusted at will, in order that the optimal positioning of each member 12 with respect to the foundation 22 and with respect to the other opposite member 12 can be reached.

Figure 2:
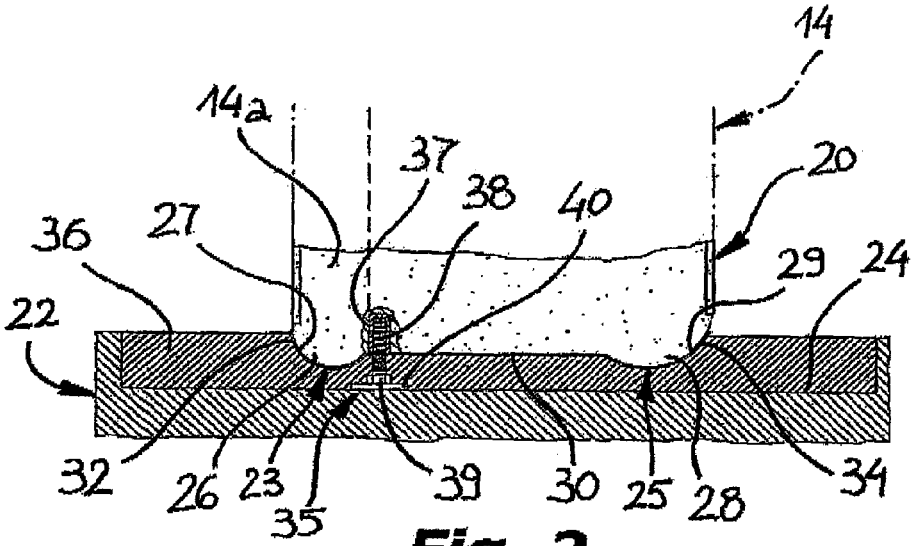
FIG. 2 is an enlarged and partially sectioned view of a detail indicated by arrow II in FIG. 1.

In the present embodiment of the invention, the support means 35 comprise a pair of threaded bushes 37 (FIG. 2) for each upright 14, each of which is incorporated in the base portion 20 at a respective side of the upright 14. A screw 38 is engaged in each bush 37, which has a head 39 protruding towards the foundation 22 and provided with a support plate 40. The head 39 of the screw 38 has a control formation, for example a hexagonal section, for allowing the engagement by a tool, such as a control wrench, for the purpose of rotating it in order to vary the extension of the screw 38 with respect to the respective bush 37. The bushes 37 and the screws 38 are in particular dimensioned so as to be at least able to support the weight of the respective member 12 during the installation of the work.

Figure 3:
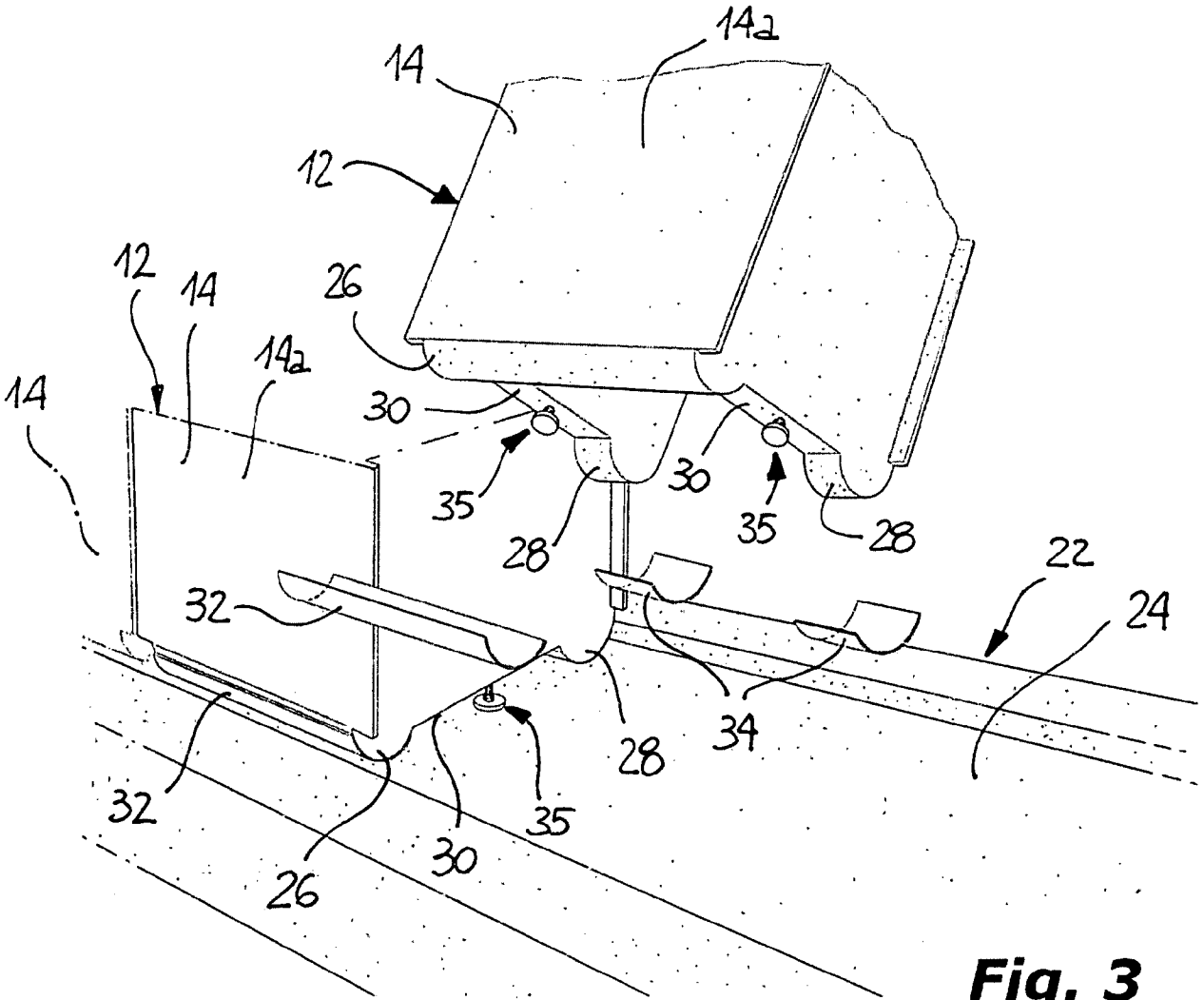
FIG. 3 is a perspective and partially exploded view schematically showing the step in which a structural member is borne on the respective foundation, before a bearing system according to the invention is made.

As it appears more clearly from FIG. 3, during the installation, the base portion 20 of the upright 14 of each prefabricated member 12 is placed inside the support seat 24 of the respective foundation 22, possibly side by side with another member 12 installed beforehand. If necessary, the support means 35 can be adjusted until the desired attitude of the member 12 has been attained.

When one member 12 has been installed or a plurality of members 12 have been installed in this manner, a concrete casting 36 is executed during the work in the support seat 24 of the foundation 22, between such a seat and the upright 14 of the members 12 concerned, in order to fill up the space between the bottom of the seat 24 and the base portion 20 of each upright 14, in such a manner that the support seat 24 on the one side, and the base portion 20 on the other side, carry out the function of a die and a counter-die. In this manner, when the casting 36 is hardened, complementary concave surfaces 27 and 29 are formed in correspondence with the convex appendages 26 and 28, which constitute the other half-portion of each static hinge 23 and 25.

Once the casting 36 is hardened, the weight of the members 12 and the loads applied thereto will be supported by the zones of contact between the casting 36 and the base portion 20, so that the screws 38 can also collapse without any influence on the structure.

A layer 32, 34 of anti-friction material is preferably interposed between each convex appendage 26, 28 and the respective concave surface 27, 29, for the purpose of preventing sticking of the portions of the two static hinges which are intended to rotate and of reducing the tangential friction of the touching portions, in order to favour the sliding of the convex appendages 26, 28 on the concave surfaces 27, 29 when the static hinges work. Therefore, the layers 32, 34 are intended to act as a connection lubricant and may consist of a sheet of polymer plastic material such as high-density polyethylene, which is deformed permanently as a result of the relative movement of the portions, or polyvinyl chloride, which determines a low friction coefficient between the portions which are subject to a relative rotation, or of another easily deformable plastic material having a low friction coefficient with respect to concrete. In the case in which the loads applied are not too high, it may be enough to apply a good quality bituminous paint layer on the appendages 26 and 28.

By virtue of the provision of two static hinges 23 and 25 separated to each other at the zone of the base portion 20 of the prefabricated members 12 which bears on the foundation 22, the rotation of the members 12 is allowed indifferently about the center of one or the other static hinge 23 or 25 as a result of the stresses applied to each member 12. Therefore, the bearing system of the invention works as a fixed joint when the resultant of the forces applied to the member 12 is directed so as to pass within the space delimited by the axes of the two static hinges 23 and 25, or works as an articulation when the resultant of the forces applied to the member 12 is directed so as to pass outside the space delimited by the axes of the two static hinges 23 and 25. In the latter condition, the member 12 is subject to a rotation about the static hinge 23 or 25 which is closer to the straight line of action of the resultant of the forces, until a balance configuration is attained, in which the resultant passes through the axis of that static hinge.

What is claimed is:

1. A system for articulably bearing a prefabricated structural member on a foundation, comprising a first static hinge interposed between a base of an upright of the prefabricated structural member and the foundation, wherein the system further comprises a second static hinge arranged between the base of said upright and the foundation, which said second static hinge has an axis of rotation parallel to and separated from that of the first static hinge, said first and additional static hinges being formed by complimentary first and second half-portions, the first half portion comprising a pair of convex appendages extending from the base of the same upright, said convex appendages rotatably engaging correspondingly shaped concave surfaces formed on the foundation and constituting the second half-portion of said static hinges.

2. The system according to claim 1, wherein each convex appendage is defined by a respective cylindrical surface.

3. The system according to claim 1, wherein the foundation has an upwardly open channel-shaped bearing seat.

4. The system according to claim 3, wherein both said concave surfaces are formed during the work between the base of the structural member and the bearing seat of the foundation by means of a concrete casting directed toward the base, after having placed the base on the foundation.

5. The system according to claim 4, wherein the upright is provided with support means for supporting it on the foundation, which are interposed between the static hinges and are adapted to hold the base of the upright raised with respect to the bearing seat of the foundation.

6. The system according to claim 5, wherein the support means of the upright have an adjustable extension in order to allow the distance between the base of the upright and the bearing seat of the foundation to be modified.

7. The system according to claim 6, wherein the support means of the upright are incorporated in the base of the prefabricated member in an intermediate position between the static hinges.

8. The system according to claim 6, wherein the support means of the upright comprise at least a threaded bush incorporated in the base of the upright and in which a screw extending towards the foundation is engaged, the screw being provided with a control formation to allow to adjust, by means of a tool, the extension of the screw with respect to the threaded bush.

9. The system according to claim 1, wherein a layer of anti-friction material is interposed between each of said convex appendages and the respective concave surface, said layer being adapted to separate the concrete castings and to favour the relative sliding of the convex appendages with respect to the concave surfaces.

10. The system according to claim 1, including a prefabricated U-shaped or L-shaped structural member, or a prefabricated structural member intended to assume an overturned U-shape or L-shape in the installed condition, each prefabricated structural member being adapted to be associated symmetrically to another similar structural member in order to form arched segments of an open-air work, the upright or each upright of each prefabricated structural member bearing, in the installed condition, on a foundation having a bearing seat in which a concrete casting is formed during the work between each upright and said seat of the foundation in order to form a concave surface so shaped as to correspond to the convex appendages of each upright.

11. The system according to claim 10, including adjustable support means adapted to support each structural member on the foundation and to allow the adjustment of the position thereof before said concrete casting is formed.

* * * * *